US009939764B2

(12) United States Patent
Koga et al.

(10) Patent No.: US 9,939,764 B2
(45) Date of Patent: Apr. 10, 2018

(54) FIXING BELT, FIXING DEVICE, AND IMAGE FORMING APPARATUS

(71) Applicant: Konica Minolta, Inc., Tokyo (JP)

(72) Inventors: Hirofumi Koga, Tokyo (JP); Izumi Mukoyama, Tokyo (JP); Naoko Uemura, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/481,069

(22) Filed: Apr. 6, 2017

(65) Prior Publication Data

US 2017/0308011 A1 Oct. 26, 2017

(30) Foreign Application Priority Data

Apr. 20, 2016 (JP) ..... 2016-084344

(51) Int. Cl.
*G03G 15/20* (2006.01)

(52) U.S. Cl.
CPC . *G03G 15/2053* (2013.01); *G03G 2215/2016* (2013.01)

(58) Field of Classification Search
CPC ..... G03G 15/2053; G03G 15/2057; G03G 2215/2016
USPC ..... 399/329, 333
See application file for complete search history.

(56) References Cited

U.S. PATENT DOCUMENTS

2003/0127173 A1* 7/2003 Kamiya ..... G03G 15/2057 156/64
2005/0117943 A1* 6/2005 Nakafuji ..... G03G 15/2064 399/328
2012/0128953 A1* 5/2012 Kuraoka ..... B32B 5/145 428/215

FOREIGN PATENT DOCUMENTS

JP 2005055470 A 3/2005
JP 2005084134 A 3/2005
JP 2008255283 A 10/2008
JP 2013025120 A 2/2013

* cited by examiner

*Primary Examiner* — Sophia S Chen
(74) *Attorney, Agent, or Firm* — Lucas & Mercanti, LLP

(57) ABSTRACT

A fixing belt includes a base layer, an elastic layer made of an elastic material, and a release layer. The elastic layer includes a first elastic layer disposed on a side of the base layer, and a second elastic layer disposed on a side of the release layer. The second elastic layer has a lower hardness than that of the first elastic layer. A Universal hardness of the second elastic layer is 3 to 7 N/mm$^2$. A thickness ratio of the second elastic layer to the elastic layer is 5 to 15%.

9 Claims, 3 Drawing Sheets

FIXING BELT, FIXING DEVICE, AND IMAGE FORMING APPARATUS

CROSS REFERENCE TO RELATED APPLICATIONS

This application is entitled to and claims the benefit of Japanese Patent Application No. 2016-084344, filed on Apr. 20, 2016, the disclosure of which including the specification, drawings and abstract is incorporated herein by reference in its entirety.

BACKGROUND OF THE INVENTION

1. Field of the Invention

The present invention relates to a fixing belt, a fixing device, and an image forming apparatus.

2. Description of Related Art

A fixing device employed in an image forming apparatus, such as a copier or a laser beam printer, generally brings a heated fixing belt into contact with recording media that bear unfixed toner images, thereby fixing toner images on the recording media. Then, the recording media bearing the fixed toner images are separated from the fixing belt. Such a fixing belt is, for example, an endless belt including a base layer, an elastic layer, and a release layer laminated in this order.

As such a fixing belt, a fixing belt including two or more elastic layers each having a different thermal conductivity is known from the viewpoint of image smoothness and energy saving (e.g., Japanese Patent Application Laid-Open No. 2005-084134 (hereinafter, "Patent Literature (PTL)" 1)). Also, as such a fixing belt, a fixing belt including two or more elastic layers each having a different heat-resistant temperature is known from the viewpoint of durability (e.g., Japanese Patent Application Laid-Open No. 2005-055470 (hereinafter, "PTL" 2).

A hardness of a fixing belt affects fixability of toner images and separability of recording media. More specifically, adhesion between a fixing belt and a recording medium generally lowers as the hardness of the fixing belt increases. As a result, fixability of toner images tends to lower as separability of recording media improves. The fixing belts described in PTLs 1 and 2 occasionally fail to achieve expected fixability and separability. Accordingly, an electrophotographic image forming apparatus including each of the fixing belts described in PTLs 1 and 2 occasionally fails to form images in a stable manner due to jams of recording media. In the specification, the term "toner image" refers to an aggregated state of a toner as an image.

SUMMARY OF THE INVENTION

A first object of the present invention is to provide a fixing belt having both excellent fixability of toner images and excellent separability of recording media. Further, a second object of the present invention is to provide a fixing device and an image forming apparatus that can properly separate recording media and form images in a stable manner.

In order to achieve the first object, a fixing belt reflecting one aspect of the present invention is an endless fixing belt including a base layer, an elastic layer made of an elastic material, and a release layer, in which the elastic layer including a first elastic layer disposed on a side of the base layer, and a second elastic layer that is disposed on a side of the release layer and has a lower Universal hardness than that of the first elastic layer, a Universal hardness of the second elastic layer is 3 to 7 N/mm$^2$, and a thickness ratio of the second elastic layer to the elastic layer is 5 to 15%.

In order to achieve the second object, a fixing device reflecting one aspect of the present invention includes: an endless fixing belt; two or more rollers that rotatably support the fixing belt; a heater that heats the fixing belt; and a pressure roller that presses a portion of the fixing belt that is rotatably supported by one of the two or more rollers; in which the endless fixing belt is the fixing belt according to the present invention, and a pressing force of the pressure roller is 9.8 N/cm$^2$ or higher.

In order to achieve the second object, an image forming apparatus reflecting one aspect of the present invention is an image forming apparatus including a fixing device for fixing an unfixed toner image formed on a recording medium by an electrophotographic process on the recording medium by heating or pressing, in which the fixing device is the fixing device according to the present invention.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

[Fixing Belt]

Figure 1A:
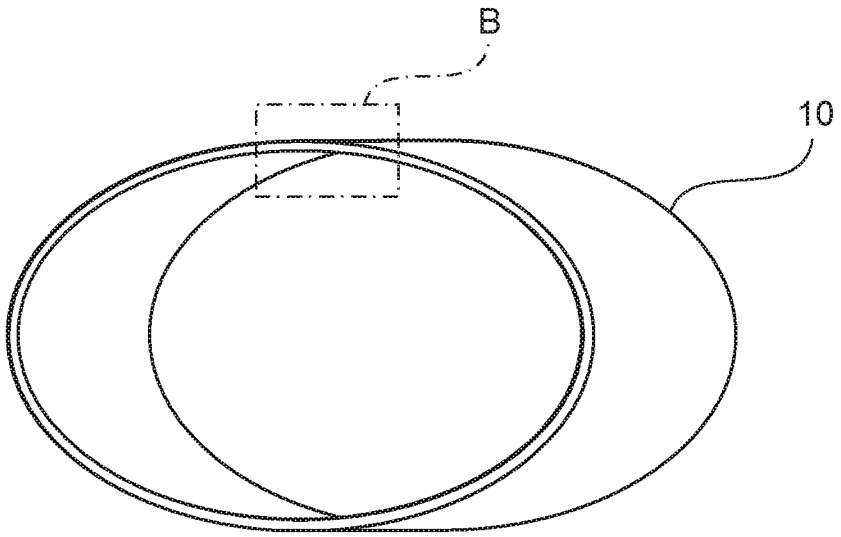
FIG. 1A is a schematic view illustrating a configuration of a fixing belt according to an embodiment of the present invention.
Figure 1B:
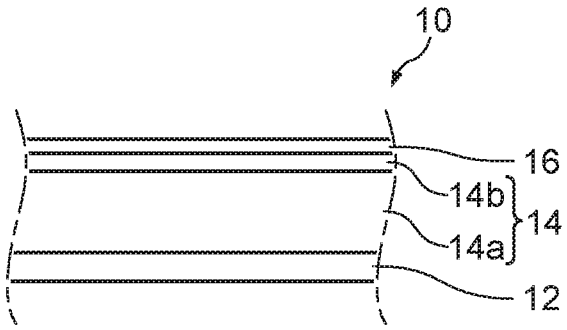
FIG. 1B is an enlarged view of region B in FIG. 1A.

FIGS. 1A and 1B illustrate a configuration of fixing belt 10 according to an embodiment of the present invention. FIG. 1A is a perspective view of a fixing belt, and FIG. 1B is an enlarged view of region B in FIG. 1A.

Fixing belt 10 according to the embodiment includes base layer 12 made of a heat-resistant resin, elastic layer 14 made of an elastic material, and release layer 16. In the embodiment, base layer 12, elastic layer 14, and release layer 16 are laminated in this order. Fixing belt 10 has an endless shape.

Base layer 12 is made of a heat-resistant resin. The heat-resistant resin may be appropriately selected from one or more types of resins that are free from degeneration and deformation at an operating temperature of fixing belt 10. Examples of the heat-resistant resin include polyphenylene sulfide, a polyarylate, a polysulfone, a polyether sulfone, a polyether-imide, a polyimide, a polyamide-imide, and a polyether ether ketone. Among them, the heat-resistant resin is preferably a polyimide from the viewpoint of heat resistance.

A polyimide can be obtained by dehydration/cyclization (imidization) reaction of a polyamic acid, which is a precursor of a polyimide, through heating at 200° C. or higher, or using a catalyst. A polyamic acid may be a commercially available product, or may be manufactured by dissolving a tetracarboxylic dianhydride and a diamine compound in a solvent, then polycondensing through mixing/heating.

Examples of the diamine compound and the tetracarboxylic dianhydride include compounds described in paragraphs 0123 to 0130 of Japanese Patent Application Laid-Open No. 2013-025120.

Base layer 12 may further contain components other than the heat-resistant resin as long as the effect of the present embodiment is obtained. For example, a material for base layer 12 may further contain a resin component other than the heat-resistant resin. The content of the heat-resistant resin in the material for base layer 12 is preferably 40 to 100 vol % from the viewpoint of moldability and the like.

Elastic layer 14 includes first elastic layer 14*a* disposed on a side of base layer 12, and second elastic layer 14*b* disposed on a side of release layer 16. In the embodiment, base layer 12, first elastic layer 14*a*, second elastic layer 14*b*, and release layer 16 are laminated in this order.

The hardness of each first elastic layer 14*a* and second elastic layer 14*b* is appropriately adjusted from the viewpoint of achieving desired fixability and separability. The Universal hardness of first elastic layer 14*a* is preferably 5 to 11 N/mm$^2$ from the viewpoint of achieving both fixability and separability. When the Universal hardness of first elastic layer 14*a* is lower than 5 N/mm$^2$, sufficient separability may not be achieved, whereas when the Universal hardness of first elastic layer 14*a* is higher than 11 N/mm$^2$, sufficient fixability may not be achieved.

Second elastic layer 14*b* has a lower hardness than that of first elastic layer 14*a*. Although the details will be described hereinafter, the Universal hardness of second elastic layer 14*b* is 3 to 7 N/mm$^2$ from the viewpoint of achieving both fixability and separability. When the Universal hardness of second elastic layer 14*b* is lower than 3 N/mm$^2$, sufficient separability cannot be achieved, whereas when the Universal hardness of second elastic layer 14*b* is higher than 7 N/mm$^2$, sufficient fixability cannot be achieved.

A difference in Universal hardness between first elastic layer 14*a* and second elastic layer 14*b* can be appropriately adjusted in accordance with the thickness of first elastic layer 14*a* and the thickness of second elastic layer 14*b*. The difference in Universal hardness between first elastic layer 14*a* and second elastic layer 14*b* is preferably large from the viewpoint of achieving sufficient fixability. From the viewpoint of achieving both fixability and separability, however, the relationship between a layer thickness of each first elastic layer 14*a* and second elastic layer 14*b*, and a Universal hardness of each first elastic layer 14*a* and second elastic layer 14*b* needs to be taken into account. For example, when the Universal hardness of first elastic layer 14*a* is high, both fixability and separability can be achieved since the overall hardness of fixing belt 10 can be maintained even if the thickness of second elastic layer 14*b* is increased a little. When the Universal hardness of first elastic layer 14*a* is low, however, an excessively large thickness of second elastic layer 14*b* may lower the overall hardness of fixing belt 10, thereby failing to achieve both fixability and separability. Accordingly, the difference in Universal hardness between first elastic layer 14*a* and second elastic layer 14*b* is preferably 0.1 to 5 N/mm$^2$, and more preferably 0.1 to 2 N/mm$^2$.

The Universal hardness of each first elastic layer 14*a* and second elastic layer 14*b* may be measured using commonly known hardness testers (e.g., H-100V; from Fischer Instruments K.K.) The Universal hardness of first elastic layer 14*a* may be measured, for example, in a state where a sample, which is prepared by removing base layer 12 from fixing belt 10 to expose first elastic layer 14*a* outside, is fixed on a resin substrate using an adhesive, a tape, or the like. Also, the Universal hardness of second elastic layer 14*b* may be measured, for example, in a state where a sample, which is prepared by removing release layer 16 from fixing belt 10 to expose second elastic layer 14*b* outside, is fixed on a resin substrate using an adhesive, a tape, or the like.

The Universal hardness can be adjusted in accordance with a molecular weight of an elastic material, an addition amount of a crosslinker, and/or an addition amount of a filler. For example, the higher the molecular weight of an elastic material and the crosslinking density of the elastic material become, the higher the Universal hardness can become. Also, the higher the addition amount of a crosslinker becomes, the higher the Universal hardness can become. Further, the higher the addition amount of a filler (described hereinafter) becomes, the higher the Universal hardness can become.

Elastic layer 14 is made of an elastic material. Examples of a material (elastic material) for elastic layer 14 include an elastic resin material, such as a silicone rubber, a thermoplastic elastomer, or a rubber material. The elastic material is preferably a silicone rubber from the viewpoint of heat resistance and elasticity. Materials for first elastic layer 14*a* and second elastic layer 14*b* may be the same or different, but preferably the same.

The silicone rubber may be one type or more. Examples of the silicone rubber include a polyorganosiloxane and a heat-vulcanized article thereof. For example, the silicone rubber is a heat-vulcanized article formed from 100 parts by weight of dimethyl polysiloxane (viscosity 50000 mPa-s, vinyl group amount 0.00009 mol/g), 2 parts by weight of fumed silica, 50 parts by weight of quartz powders, 0.5 part by weight of cerium oxide powders, 1.2 parts by weight of SiH group-containing methyl hydrogen polysiloxane (Si—H group amount/alkenyl group=1.0), and 1.1 parts by weight of methyl hydrogen polysiloxane (Si—H group amount 0.0038 mol/g) (paragraph 0051 of Japanese Patent Application Laid-Open No. 2008-255283) or a heat-vulcanized article formed from 80 parts by weight of vinyl group-containing dimethyl polysiloxane (viscosity 20000 mPa-s, vinyl group amount 0.0001 mol/g), 20 parts by weight of vinyl group-free dimethyl polysiloxane (viscosity 5000 mPa-s, vinyl group amount 0.000055 mol/g), 0.8 part by weight of SiH group-containing methyl hydrogen polysiloxane (Si—H group amount/alkenyl group=1.0), 80 parts by weight of quartz powders, 1 part by weight of iron oxide, 0.5 part by weight of fumed silica, and 250 parts by weight of alumina (paragraph 0045 of Japanese Patent Application Laid-Open No. 2008-255283).

The thickness of elastic layer 14 is preferably small from the viewpoint of enhancing heat transfer of elastic layer 14. In contrast, the thickness of elastic layer 14 is preferably large from the viewpoint of enhancing elasticity of elastic layer 14 and fixability. For example, the thickness of elastic layer 14 is preferably 100 to 500 μm, more preferably 150 to 450 μm, and further preferably 200 to 400 μm.

The thickness of first elastic layer 14*a* is preferably 100 to 400 μm from the viewpoint of achieving both fixability and separability.

A thickness ratio of second elastic layer 14*b* to elastic layer 14 is 5 to 15% from the viewpoint of achieving sufficient fixability and separability. When the ratio is less than 5%, second elastic layer 14*b* may not make a sufficient contribution at the time of fixing in an image forming apparatus. Also, when the ratio is more than 15%, first elastic layer 14*a* may not make a sufficient contribution at the time of fixing in an image forming apparatus. From the above viewpoint, the thickness of second elastic layer 14*b* is preferably 5 to 30 μm. Meanwhile, when the thickness of second elastic layer 14*b* is less than 5 μm, a uniform film may not be formed.

Elastic layer 14 may further contain components other than the elastic resin material as long as the effect of the present embodiment is obtained. For example, the elastic material may further contain a filler for enhancing heat transfer of elastic layer 14. Examples of the filler include silica, metallic silica, alumina, zinc oxide, aluminum nitride, boron nitride, silicon nitride, silicon carbide, carbon, and graphite. The filler is not limited in its form, and may be spherical powders, amorphous powders, flat powders, or fibers, for example.

Elastic layer 14 may include other layers as long as the effect of the embodiment of the present invention is obtained. For example, first elastic layer 14*a* may include an intermediate layer having an intermediate hardness between first elastic layer 14*a* and second elastic layer 14*b*. The intermediate layer is, for example, a layer disposed on the second elastic layer 14*b* side of first elastic layer 14*a*, which may be formed through mixing of first elastic layer 14*a* and second elastic layer 14*b* upon lamination of second elastic layer 14*b* on first elastic layer 14*a*. The thickness of the intermediate layer is small relative to first elastic layer 14*a*, and about 10 μm, for example.

Release layer 16 has suitable releasability of toner components. Release layer 16 constitutes an outer peripheral surface of a fixing belt, which is brought into contact with recording media at the time of fixing. Examples of a material for release layer 16 include polyethylene, polypropylene, polystyrene, polyisobutylene, a polyester, a polyurethane, a polyamide, a polyimide, a polyamide-imide, an alcohol-soluble nylon, a polycarbonate, a polyarylate, phenol, polyoxymethylene, a polyether ether ketone, a polyphosphazene, a polysulfone, a polyether sulfide, polyphenylene oxide, polyphenylene ether, a polyparabanic acid, a polyallylphenol, a fluororesin, a polyurea, an ionomer, a silicone, and a mixture or a copolymer thereof. The material for release layer 16 is preferably a fluororesin, and more preferably a perfluoroalkoxy alkane (PFA) from the above-mentioned viewpoint of releasability and heat resistance.

The thickness of release layer 16 is preferably, for example, 5 to 40 μm, more preferably 10 to 35 μm, and further preferably 20 to 30 μm from the viewpoint of exhibiting heat transfer, conformity to deformation of elastic layer 14, and releasability.

Release layer 16 may further contain components other than the above-mentioned resin matrix materials as long as the effect of the present embodiment is obtained. For example, release layer 16 may further contain lubricant particles. Examples of the lubricant particles include fluororesin particles, silicone resin particles, and silica particles.

The content of the resin matrix materials in a material for release layer 16 is preferably 70 to 100 vol % from the viewpoint of heat transfer and flexibility to fully conform to deformation of elastic layer 14.

The MD-1 hardness of fixing belt 10 is preferably 80 to 95 from the viewpoint of fixability and separability. The MD-1 hardness of fixing belt 10 can be measured, for example, with type C micro rubber hardness tester MD-1 according to JIS K 6253 (2012) (corresponding to ISO 7619, the same shall apply hereinafter).

Fixing belt 10 may further include layers other than base layer 12, elastic layer 14, and release layer 16 as long as the effect of the embodiment is exerted. Examples of such layers include a reinforcing layer.

The reinforcing layer is a layer for enhancing mechanical strength of fixing belt 10, and is disposed, for example, on a surface of fixing belt 10 on the opposite side to elastic layer 14 and release layer 16 (an inner peripheral surface of base layer 12). The reinforcing layer can be composed of the above-mentioned heat-resistant resins, and the thickness can be determined appropriately.

Fixing belt 10 can be manufactured according to a commonly known method for manufacturing a laminate-type fixing belt. For example, fixing belt 10 can be manufactured by a method including: applying an elastic material (which forms first elastic layer 14*a*) or a precursor thereof on an outer surface of an endless molding made of the above-mentioned heat-resistant resins (which constitutes base layer 12); heat-vulcanizing the elastic material or the precursor; applying an elastic material (which forms second elastic layer 14*b*) or a precursor thereof on first elastic layer 14*a* formed on the outer surface of base layer 12; heat-vulcanizing the elastic material or the precursor; and covering second elastic layer 14*b* with a tube (which constitutes release layer 16).

The hardness of elastic layer 14 affects fixability of toner images, separability of recording media, and bleeding properties of waxes contained in toners. Elastic layer 14 tends to have a higher repulsive force against recording media as the hardness becomes higher. Accordingly, from the viewpoint of separability, a high hardness of elastic layer 14 is preferable. Further, elastic layer 14 tends to have a higher pressing force against toners as the hardness becomes higher. Accordingly, also from the viewpoint of bleeding properties of waxes, a high hardness of elastic layer 14 is preferable. In contrast, when the hardness of elastic layer 14 is high, adhesion between recording media and a fixing belt tends to lower. This tendency becomes more noticeable as surfaces of recording media become rougher. Accordingly, from the viewpoint of fixability, a low hardness of elastic layer 14 is preferable.

Elastic layer 14 of fixing belt 10 according to the embodiment includes first elastic layer 14*a* disposed on a side of base layer 12, and second elastic layer 14*b* disposed on a side of release layer 16. Second elastic layer 14*b* of fixing belt 10 according to the embodiment has a lower hardness than that of first elastic layer 14*a*, and a small thickness ratio of second elastic layer 14*b* to elastic layer 14. Specifically, the Universal hardness of second elastic layer 14*b* is 3 to 7 $N/mm^2$, and the thickness ratio of second elastic layer 14*b* to elastic layer 14 is 5 to 15%. A low hardness of elastic layer 14 (second elastic layer 14*b*) on the side of release layer 16, which comes into contact with recording media, can achieve sufficient adhesion between recording media and fixing belt 10. In addition, the thickness ratio of second elastic layer 14*b* to elastic layer 14 of 5 to 15% can maintain the overall hardness of elastic layer 14, thereby achieving sufficient repulsion of fixing belt 10. As a result, fixing belt 10 according to the embodiment can achieve both sufficient separability and fixability.

Further, when a toner contains a wax, a high repulsive force of fixing belt 10 (a pressing force against a toner) can increase an amount of bleeding of the wax, thereby enhancing separability of recording media.

Fixing belt 10 is preferably employed as a fixing belt of the following biaxial belt-type fixing device, and exerts remarkable effects in an image forming apparatus.

[Fixing Device]

Figure 2:
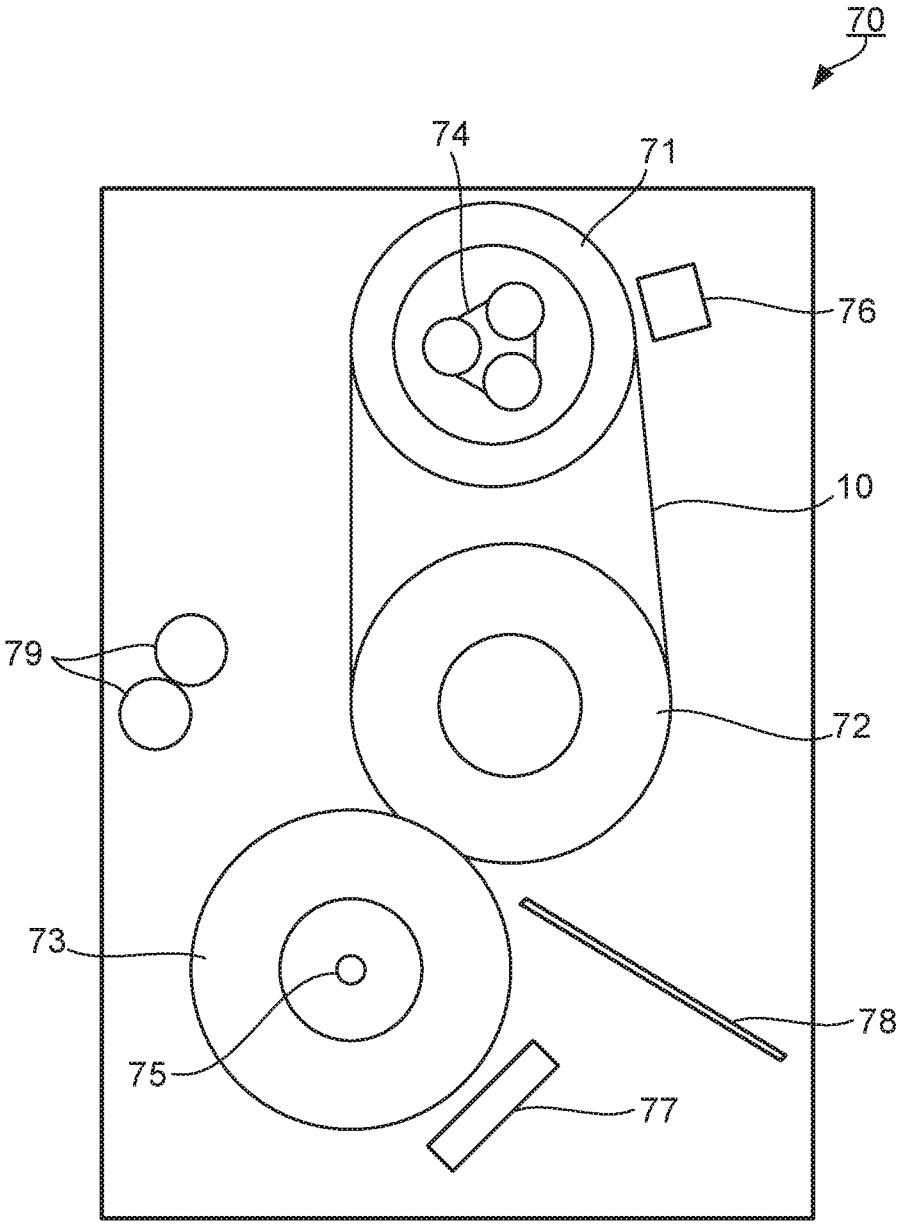
FIG. 2 is a schematic view illustrating a configuration of a fixing device according to an embodiment of the present invention.

FIG. 2 is a schematic view illustrating a configuration of fixing device 70 according to an embodiment of the present invention. Fixing device 70 according to the embodiment of the present invention includes fixing belt 10, first roller 71, second roller 72, pressure roller 73, first heater 74, second heater 75, first temperature sensor 76, second temperature sensor 77, guide plate 78, and guide rollers 79. The pressing force of pressure roller 73 is 9.8 N/cm$^2$ or higher. Further, fixing device 70 can be configured in the same manner as a commonly known so-called biaxial belt-type fixing device except for including the above-mentioned fixing belt 10.

The number of rollers that rotatably support fixing belt 10 is two or more. In fixing device 70 according to the embodiment, first roller 71 and second roller 72 rotatably support fixing belt 10.

First roller 71 rotatably supports fixing belt 10 together with second roller 72. First roller 71 according to the embodiment is also a heating roller that includes first heater 74 for heating fixing belt 10. First roller 71 is, for example, a rotatable heat-transferring aluminum sleeve having elasticity on the outer surface. First heater 74 may be a heating source, such as a halogen heater, disposed inside the sleeve, or a heating source, such as a halogen heater, disposed to face fixing belt 10. In the embodiment, first heater 74 is a heating source disposed inside the sleeve.

Second roller 72 rotatably supports fixing belt 10 together with first roller 71. Second roller 72 is, for example, a roller having elasticity on the outer peripheral surface. Moreover, in the embodiment, second roller 72 forms a fixing nip portion together with pressure roller 73.

The tensile force of fixing belt 10, which is rotatably supported by first roller 71 and second roller 72, is 45 N or lower, for example. The tensile force can be adjusted, for example, by elastic force (thrusting force) of an elastic member, such as a spring, exerted on first roller 71 or second roller 72 or the both along the direction for increasing the inter-axial distance between first roller 71 and second roller 72, or by the inter-axial distance between first roller 71 and second roller 72 that rotatably support fixing belt 10.

Pressure roller 73 presses a portion of fixing belt 10 rotatably supported by second roller 72. Pressure roller 73 is disposed to face second roller 72 through fixing belt 10. Pressure roller 73 constitutes a contact portion with fixing belt 10 at the time of fixing (a fixing nip portion). Pressure roller 73 is, for example, a roller having elasticity on the outer peripheral surface, and having a rotational axis that can approach and move away from fixing belt 10. When approaching second roller 72, pressure roller 73 presses the outer surface of second roller 72 through fixing belt 10, and forms a fixing nip portion, which is a contact portion with fixing belt 10.

When the fixing nip portion is fixed by pressing with pressure roller 73, the pressing force of pressure roller 73 is 9.8 N/cm$^2$ or higher. The pressing force of pressure roller 73 can be adjusted, for example, by elastic force (thrusting force) of an elastic material, such as a spring, exerted on pressure roller 73, or by the inter-axial distance between second roller 72 and pressure roller 73.

Pressure roller 73 according to the embodiment includes second heater 75. Pressure roller 73 is, for example, a rotatable heat-transferring aluminum sleeve. Second heater 75 is a heating source, such as a halogen heater, disposed inside the sleeve. Pressure roller 73 according to the embodiment is also a heating roller.

First temperature sensor 76 is a device for detecting a temperature of fixing belt 10 heated by first roller 71, and second temperature sensor 77 is a device for detecting a temperature of the outer peripheral surface of pressure roller 73.

Guide plate 78 is a member for guiding recording media that bear unfixed toner images to the above-mentioned fixing nip portion, and guide rollers 79 are a member for guiding recording media that bear fixed toner images to the outside of an image forming apparatus from the fixing nip portion.

Fixing device 70 may further include a component other than those described above as long as the effect of the embodiment of the present invention is obtained. Examples of such components include a shaft-moving mechanism for pressure roller 73 and an airflow separation device that generates airflow for peeling off recording media. As such components, commonly known members of commonly known fixing devices can be employed.

Because fixing device 70 includes pressure roller 73 having a pressing force of 9.8 N/cm$^2$ or higher and fixing belt 10, fixing device 70 can press recording media with a high repulsive force and achieve excellent bleeding properties of waxes from toners at the time of fixing. Thus, fixing device 70 may not include a separate oil application mechanism for applying an oil to either or both fixing belt 10 and pressure roller 73, since fixing device 70 can separate recording media with high separability.

Fixing belt 10 is heated, for example, by first heater 74 to a desired temperature (e.g., 190° C.) under feedback control by first temperature sensor 76. Pressure roller 73 is heated, for example, by second heater 75 to a desired temperature (e.g., 180° C.) under feedback control by second temperature sensor 77. Pressure roller 73, then, exerts force on the outer peripheral surface of second roller 72 through fixing belt 10 upon arrival of a recording medium, and forms a fixing nip portion.

A recording medium bearing an unfixed toner image is guided to the fixing nip portion by guide plate 78. Sufficiently heated fixing belt 10 fully adheres to the recording medium and immediately fixes the unfixed toner image on the recording medium.

A recording medium separated from fixing belt 10 is guided to the outside of an image forming apparatus by guide rollers 79.

Meanwhile, the fixing nip portion may be formed by depressed outer peripheral surface of second roller 72 and fixing belt 10, or may be formed by depressed outer peripheral surface of pressure roller 73, as described above. Further, the fixing nip portion may be formed by moving pressure roller 73 adjacent to the side of second roller 72, or may be formed by moving first roller 71 and second roller 72 adjacent to the side of pressure roller 73, as described above.

[Image Forming Apparatus]

Figure 3:
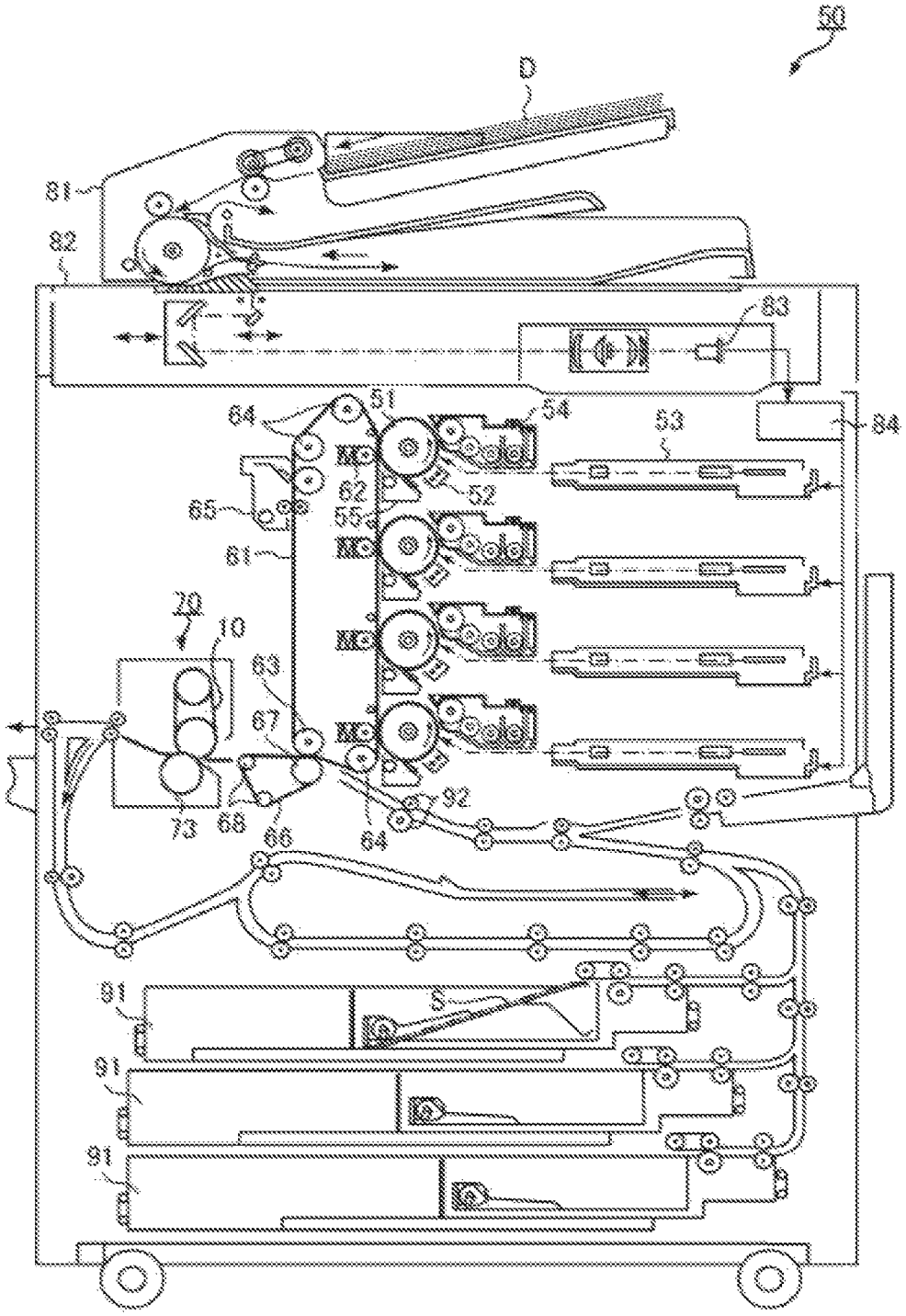
FIG. 3 is a schematic view illustrating a configuration of an image forming apparatus according to an embodiment of the present invention.

FIG. 3 is a schematic view illustrating a configuration of image forming apparatus 50 according to an embodiment of the present invention. Image forming apparatus 50 includes fixing device 70 for fixing an unfixed toner image formed on a recording medium by an electrophotographic process on the recording medium by heating and pressing. Image forming apparatus 50 can be configured in the same manner as a commonly known image forming apparatus except for employing fixing device 70 as the fixing device.

Image forming apparatus 50 includes an image forming section, an intermediate transfer section, fixing device 70, image reading section, and recording medium conveyance section.

The image forming section includes, for example, four image forming units corresponding to colors of yellow, magenta, cyan, and black. The image forming units, as illustrated in FIG. 3, each includes photoconductor drum 51, charging device 52 that charges photoconductor drum 51, exposing device 53 that irradiates charged photoconductor drum 51 with light to form an electrostatic latent image, developing device 54 that feeds a toner to photoconductor drum 51 bearing the electrostatic latent image so as to form a toner image corresponding to the electrostatic latent image, and cleaning device 55 that removes a residual toner from photoconductor drum 51.

Photoconductor drum 51 is, for example, a negative charging-type organic photoconductor having photoconductivity. Charging device 52 is a corona charger, for example. Charging device 52 may be a contact charger that charges photoconductor drum 51 by bringing a contact charging member, such as a charging roller, a charging brush, or a charging blade, into contact with photoconductor drum 51. Exposing device 53 is configured as a semiconductor laser, for example. Developing device 54 is, for example, a commonly known developing device of an electrophotographic image forming apparatus.

The intermediate transfer section includes a primary transfer unit and a secondary transfer unit. The primary transfer unit includes intermediate transfer belt 61, primary transfer rollers 62, backup roller 63, a plurality of support rollers 64, and cleaning device 65. Intermediate transfer belt 61 is an endless belt. Intermediate transfer belt 61 is tensionally looped around backup roller 63 and support rollers 64. Intermediate transfer belt 61 runs on an endless track unidirectionally at a constant speed by driving the rotation of at least one roller among backup roller 63 and support rollers 64.

The secondary transfer unit includes secondary transfer belt 66, secondary transfer roller 67, and a plurality of support rollers 68. Secondary transfer belt 66 is also an endless belt. Secondary transfer belt 66 is tensionally looped around secondary transfer roller 67 and support rollers 68.

Fixing device 70 is fixing device 70 illustrated in FIG. 2, for example. Sheets S correspond to recording media.

The image reading section includes sheet feeding device 81, scanner 82, CCD sensor 83, and image processing section 84. The recording medium conveyance section includes three sheet feeding tray units 91 and a plurality of registration roller pairs 92. The sheet feeding tray units 91 store, according to predetermined types, sheets S (standard paper, special paper) classified based on basis weight, size, or the like. Registration roller pairs 92 are disposed to form an expected conveying path.

[Image Forming Method]

An image forming method includes a step of fixing an unfixed toner image formed on a recording medium by an electrophotographic process, on the recording media by heating and pressing using fixing device 70. The image forming method can be performed by image forming apparatus 50. As an example of the image forming method, image formation by image forming apparatus 50 will be described hereinafter.

Scanner 82 optically scans originals D, which have been sent from sheet feeding device 81 onto a contact glass, and reads them. The reflected light from originals D is read by CCD sensor 83 as input image data. Input image data undergoes predetermined image processing at image processing section 84, and is transmitted to exposing device 53.

Meanwhile, photoconductor drum 51 rotates at a constant peripheral speed corresponding to a printing speed of 60 sheets/min or more for A4 recording media.

Charging device 52 evenly and negatively charges the surface of photoconductor drum 51. Exposing device 53 irradiates photoconductor drum 51 with a laser beam corresponding to input image data of each color component. Thus, an electrostatic latent image is formed on the surface of photoconductor drum 51. Developing device 54 visualizes the electrostatic latent image by adhering a toner to the surface of photoconductor drum 51. Thus, a toner image corresponding to the electrostatic latent image is formed on the surface of photoconductor drum 51. The toner image on the surface of photoconductor drum 51 is transferred to intermediate transfer belt 61. Residual toner on photoconductor drum 51 after transfer is removed by cleaning device 55. The toner image of each color formed on each photoconductor drum 51 is transferred to intermediate transfer belt 61 so as to be stacked successively.

Meanwhile, secondary transfer roller 67 presses secondary transfer belt 66 against backup roller 63, thereby bringing secondary transfer belt 66 into contact with intermediate transfer belt 61. Thus, a secondary transfer nip portion is formed. At the same time, sheets S are conveyed from sheet feeding tray units 91 to the secondary transfer nip portion via registration roller pairs 92. Registration roller pairs 92 correct tilts of sheets S and adjust the timing of conveyance.

Upon arrival of conveyed sheets S on the secondary transfer nip portion, transfer voltage is applied to secondary transfer roller 67, and toner images on intermediate transfer belt 61 are transferred to sheets S. Sheets S bearing transferred toner images are conveyed to fixing device 70 by secondary transfer belt 66. Residual toner on intermediate transfer belt 61 after transfer is removed by cleaning device 65.

In fixing device 70, for example, fixing belt 10 rotates at a constant speed corresponding to a printing speed of 60 sheets/min or more for A4 recording media. When sheets S are conveyed, pressure roller 73 forms a fixing nip portion together with fixing belt 10 as described above. Sheets S are heated and pressed at the fixing nip portion, guided to the outside of image forming apparatus 50 by a repulsive force of fixing belt 10, and ejected. Thus, toner images on sheets S are formed and sheets S are ejected outside the apparatus.

Image forming apparatus 50 according to the embodiment includes fixing device 70. Since fixing belt 10 of fixing device 70 having excellent fixability and separability, image forming apparatus 50 can properly separate recording media and form images in a stable manner over a long period of time.

As is clear from the above description, the fixing belt is an endless fixing belt including the base layer, the elastic layer made of an elastic material, and the release layer, in which the elastic layer including a first elastic layer disposed on a side of the base layer, and a second elastic layer that is disposed on a side of the release layer and has a lower Universal hardness than that of the first elastic layer, a Universal hardness of second elastic layer is 3 to 7 $N/mm^2$, and a thickness ratio of the second elastic layer to the elastic layer is 5 to 15%. This enables the fixing belt to have both excellent fixability of toner images and separability of recording media.

A Universal hardness of 5 to 11 $N/mm^2$ of the first elastic layer is further effective from the viewpoint of fixability and separability.

A thickness of 5 to 30 μm of the second elastic layer is further effective from the viewpoint of fixability and separability.

A MD-1 hardness of 80 to 95 of the fixing belt is further effective from the viewpoint of fixability and separability.

A difference in Universal hardness between the first elastic layer and the second elastic layer of 0.1 to 5 $N/mm^2$ is further effective from the viewpoint of fixability and separability.

The above-mentioned fixing device includes the fixing belt in an endless shape, two or more rollers that rotatably support the fixing belt, a heater that heats the fixing belt, and a pressure roller that presses a portion of the fixing belt that is rotatably supported by one of the two or more rollers, in which the pressing force of the pressure roller is 9.8 N/cm$^2$ or higher.

Moreover, the above-mentioned image forming apparatus includes the fixing device for fixing unfixed toner images formed on recording media by an electrophotographic process on the recording media by heating and pressing. Thus, the fixing device and the image forming apparatus can properly separate recording media and form images in a stable manner.

Since the fixing belt has excellent bleeding properties of waxes from toners at the time of fixing, the fixing device may not include an oil application mechanism for applying an oil to either or both the fixing belt and the pressure roller.

According to the embodiment, a fixing belt having both excellent fixability of toner images and separability of recording media can be provided. In addition, by using the fixing belt, a fixing device and an image forming apparatus that can properly separate recording media and form images in a stable manner can be provided.

EXAMPLES

The present invention is further specifically described with the following examples and comparative examples. It is to be noted that the present invention is not limited to the examples and so forth.

[Preparation of Rubber Compositions A to D and V to Z]

Rubber composition A was prepared by appropriately containing materials, such as dimethyl polysiloxane, methyl hydrogen polysiloxane, fumed silica, quartz powders, iron oxide, cerium oxide powders, ethynylcyclohexanol (reaction controlling agent), and a platinum catalyst. Rubber composition A is a silicone rubber composition.

A 2.0 mm-thick rubber sheet for measurements was manufactured using rubber composition A under the same conditions as manufacturing conditions for a first elastic layer described hereinafter, and the following physical properties were measured. The rubber sheet manufactured from rubber composition A had a rubber hardness of 30, a tensile strength of 2.1 MPa, an elongation of 400%, a thermal conductivity of 0.3 W/m-K, and a Universal hardness of 8.4 N/mm$^2$.

The rubber hardness was measured using the rubber sheet with durometer A (ASKER Type A; from Kobunshi Keiki Co., Ltd.) according to JIS K 6253 (2012).

The tensile strength and elongation were measured using the rubber sheet with TENSILON universal material testing machine (from A&D Company, Limited). During the measurement, the rubber sheet was pulled at elongation rate 2 mm/min under an environment of 23° C. and 50% RH.

The thermal conductivity was measured using a cut piece (80 mm×120 mm) from the rubber sheet with QTM thermal conductivity meter (from Kyoto Electronics Manufacturing Co., Ltd.)

The Universal hardness (HU) was measured using the rubber sheet with a ultra-micro hardness tester (H-100V; from Fischer Instruments K.K.) The measurement conditions for the Universal hardness is described below.

Indenter shape: Vickers indenter (angle between the opposite faces at the vertex $\alpha$=136°)

Measurement environment: 20° C., 60% RH

Maximum test load: 2 mN

Loading rate and unloading rate: 0.2 mN/s

Creep time under maximum load: 5 s

Further, rubber compositions B to D and V to Z having physical properties as shown in Table 1 were prepared by adjusting types or mixing ratios of the above materials. All rubber compositions B to D and V to Z are a silicone rubber composition.

The physical properties of each rubber composition A to D and V to W are shown in Table 1.

TABLE 1

| Type | Rubber hardness [—] | Tensile strength [MPa] | Elongation [%] | Thermal conductivity [W/m-K] | Universal hardness [N/mm$^2$] |
|---|---|---|---|---|---|
| A | 30 | 2.1 | 400 | 0.3 | 8.4 |
| B | 22 | 3.1 | 250 | 0.7 | 5.5 |
| C | 42 | 3.3 | 240 | 0.7 | 12.2 |
| D | 13 | 0.6 | 800 | 0.7 | 2.5 |
| V | 40 | 4.0 | 350 | 0.3 | 11 |
| W | 28 | 2.3 | 350 | 0.3 | 7 |
| X | 20 | 2.0 | 360 | 0.3 | 5.4 |
| Y | 15 | 1.3 | 320 | 0.3 | 3.1 |
| Z | 10 | 0.9 | 400 | 0.3 | 1.2 |

[Preparation of Fixing Belt 1]

First, a stainless steel cylindrical core (outer diameter 60 mm) was brought into a close contact with an inner side of a belt substrate (base layer) made from a thermosetting polyimide resin (inner diameter 99 mm, length 360 mm, thickness 70 μm).

Then, a coating film of rubber composition A was formed on a surface of the belt substrate by applying rubber composition A (for a first elastic layer) on the surface of the belt substrate from a nozzle while the core was rotated and the nozzle was moved along the longitudinal direction of the belt substrate. The application conditions of rubber composition A are described below.

[Application Conditions]

Temperature of rubber composition A: 25° C.

Shape of nozzle discharge openings: slit shape

Distance between nozzle discharge openings and belt substrate surface: 10 mm

Discharge amount of rubber composition A: 20 mL/min

Rotational speed (circumferential speed) of core: 0.5 m/s

After that, the coating film of rubber composition A was leveled by blowing hot air while the core was rotated, and vulcanized by heating in an oven. As a result, a 185 μm-thick first elastic layer was formed on the belt substrate. The conditions for levelling and vulcanization are described below.

[Conditions for Levelling]

Amplitude of core: 40 μm

Velocity of hot air: 22 m/s

Temperature of hot air: 50° C.

Rotational speed (circumferential speed) of core: 0.4 m/s

[Vulcanization]

Heating temperature: 180° C.

Heating time: 60 min

Rotational speed (circumferential speed) of core: 0.1 m/s

Then, a second elastic layer was formed on the first elastic layer in the same manner as the formation method of the first elastic layer using rubber composition W (for second elastic layer). During the formation, the application conditions of rubber composition W to the belt substrate (e.g., a discharge amount of the rubber composition, a rotational speed of the core, a moving speed of the nozzle) were adjusted so that the thickness of the second elastic layer became 15 μm.

Finally, the second elastic layer was covered with a 30 μm-thick perfluoroalkoxy alkane (PFA) film as a release layer. Through the above procedure, fixing belt 1 comprising the belt substrate, the first elastic layer, the second elastic layer, and the release layer laminated in this order was manufactured.

The MD-1 hardness of the fixing belt 1 was 93. The MD-1 hardness of fixing belt 1 was measured with ASKER Durometer Type C (from Kobunshi Keiki Co., Ltd.) according to JIS K 6253.

[Preparation of Fixing Belts 2 to 7 and C1 to C6]

As shown in Table 2, fixing belts 2 to 7 and C1 to C6 were manufactured in the same manner as fixing belt 1 except for changing rubber compositions used.

Category, fixing belt No., and type of rubber compositions are shown in Table 2. In Table 2, "lower layer" indicates a first elastic layer, and "upper layer" indicates a second elastic layer.

TABLE 2

| Category | No. | Type: Lower layer | Type: Upper layer |
|---|---|---|---|
| Example | 1 | A | W |
| | 2 | B | X |
| | 3 | B | Y |
| | 4 | B | X |
| | 5 | A | X |
| | 6 | B | Y |
| | 7 | C | X |
| Comparative Example | C1 | A | — |
| | C2 | A | X |
| | C3 | D | V |
| | C4 | A | V |
| | C5 | B | X |
| | C6 | D | Z |

[Evaluation]

Each fixing belt was installed as a fixing belt of an electrophotographic image forming apparatus equipped with a biaxial belt-type fixing device as illustrated in FIG. 2, and evaluated as described hereinafter. As a copier, a full-color copier (bizhub Press C1070; Konica Minolta Inc.) was used, and as a toner, Digital Toner HD+(Konica Minolta Inc.) was used.

(1) Fixability

The fixability of each fixing belt was evaluated according to the following procedure. Solid images (bonded amount 8.0 g/m$^2$, 40 mm×100 mm) each composed of a cyan single layer were formed while recording media (Leathac 66, density 203 g/m$^2$, A4; Tokushu Tokai Paper, Co., Ltd.; "Leathac" is a registered trademark of this corporation) were conveyed at a rate of 30 sheets/min. During this step, toner images were fixed at a surface temperature of the fixing belt of 200° C. After that, three layers of tissue (KimWipes S-200; from Nippon Paper Industries Co., Ltd.) were piled on each rubbing surface in regions of the recording media where the toner images were fixed, and rubbed with each columnar stainless steel indenter (3 cm×3 cm, 0.4 kg). Then, the fixability of the toner images was evaluated based on the following criteria. Ranks 3 to 5 are considered to be acceptable.

Rank 5: the image does not peel even after 8 cycles of reciprocating motion of the indenter Rank 4: the image does not peel even after 5 cycles of reciprocating motion of the indenter Rank 3: the image does not peel even after 3 cycles of reciprocating motion of the indenter Rank 2: the image peels before 3 cycles of reciprocating motion of the indenter Rank 1: the image peels before 1 cycle of reciprocating motion of the indenter (2) Separability The separability of each fixing belt was evaluated according to the following procedure. Solid images (bonded amount 8.0 g/m$^2$) each composed of cyan and magenta two layers (red) were formed on recording media (art paper: OK Kanafuji, density 84.9 g/m$^2$ (long grain), A4; from Oji Paper Co., Ltd.) except for a predetermined width from the end of each recording media in the conveying direction as a margin. During this step, the images were fixed at a surface temperature of the fixing belt of 185° C. According to the following criteria, the separability between the fixing belt and a recording medium was evaluated. The following criteria are based on a width of a margin needed to separate the fixing belt and a recording medium without curling of the recording medium. Ranks 3 to 5 are considered to be acceptable.

Rank 5: the width of a margin needed for separation is 3 mm or less.

Rank 4: the width of a margin needed for separation is more than 3 mm and 5 mm or less Rank 3: the width of a margin needed for separation is more than 5 mm and 7 mm or less Rank 2: The width of a margin needed for separation is 7 mm or more and less than 10 mm Rank 1: the width of a margin needed for separation is 10 mm or more The evaluation results of fixing belts 1 to 7 and C1 to C6 are shown in Table 3. In Table 3, "lower layer" indicates a first elastic layer, "upper layer" indicates a second elastic layer, and "entire layer" indicates an elastic layer including the first elastic layer and second elastic layer.

TABLE 3

| Category | No. | Universal hardness [N/mm$^2$]: Lower layer | Universal hardness [N/mm$^2$]: Upper layer | Thickness [μm]: Upper layer | Thickness [μm]: Entire layer | Ratio [%] | MD-1 hardness [—] | Evaluation result: Fixability | Evaluation result: Separability |
|---|---|---|---|---|---|---|---|---|---|
| Example | 1 | 8.4 | 7.0 | 20 | 205 | 10 | 93 | 5 | 4 |
| | 2 | 5.5 | 5.4 | 15 | 200 | 8 | 89 | 5 | 4 |

TABLE 3-continued

| Category | No. | Universal hardness [N/mm²] Lower layer | Universal hardness [N/mm²] Upper layer | Thickness [μm] Upper layer | Thickness [μm] Entire layer | Ratio [%] | MD-1 hardness [—] | Evaluation result Fixability | Evaluation result Separability |
|---|---|---|---|---|---|---|---|---|---|
| | 3 | 5.5 | 3.1 | 15 | 200 | 8 | 86 | 4 | 5 |
| | 4 | 5.5 | 5.4 | 30 | 210 | 14 | 87 | 4 | 4 |
| | 5 | 8.4 | 5.4 | 20 | 400 | 5 | 82 | 4 | 5 |
| | 6 | 5.5 | 3.1 | 30 | 210 | 14 | 79 | 3 | 5 |
| | 7 | 12.2 | 5.4 | 15 | 200 | 8 | 92 | 5 | 3 |
| Comparative Example | C1 | 8.4 | — | — | 200 | 0 | 90 | 5 | 2 |
| | C2 | 8.4 | 5.4 | 15 | 450 | 3 | 80 | 2 | 5 |
| | C3 | 2.5 | 11 | 15 | 200 | 8 | 90 | 2 | 2 |
| | C4 | 8.4 | 11 | 15 | 200 | 8 | 94 | 5 | 1 |
| | C5 | 5.5 | 5.4 | 40 | 220 | 18 | 86 | 2 | 4 |
| | C6 | 2.5 | 1.2 | 30 | 400 | 8 | 79 | 1 | 5 |

As is clear from Table 1, all fixing belts 1 to 7 had sufficient separability and fixability in the image forming apparatus. This is presumably due to the fact that the elastic layer includes a first elastic layer and a second elastic layer, a Universal hardness of the second elastic layer is 3 to 7 N/mm², and a thickness ratio of the second elastic layer to the elastic layer is 5 to 15%.

In addition, all fixing belts 1 to 6 had further excellent separability in the image forming apparatus. This is presumably due to the fact that the MD-1 hardness of each fixing belt is 80 to 95.

Moreover, all fixing belts 1 to 5 and 7 had further excellent fixability in the image forming apparatus. This is presumably due to the fact that the Universal hardness of each first elastic layer is 5 to 11 N/mm².

In contrast, all fixing belts C1 to C6 had either or both insufficient separability and fixability in the image forming apparatus. As for fixing belt C1, this is presumably due to the fact that the elastic layer lacks a second elastic layer. As for fixing belt C2, this is presumably due to the fact that the ratio of the second elastic layer to the elastic layer is too low. As for fixing belts C3 and C4, this is presumably due to the fact that the Universal hardness of each second elastic layer is too high. As for fixing belt C5, this is presumably due to the fact that the ratio of the second elastic layer to the elastic layer is too high. Further, as for fixing belt C6, this is presumably due to the fact that the Universal hardness of the second elastic layer is too low.

INDUSTRIAL APPLICABILITY

According to the present invention, further enhanced performance of an electrophotographic image forming apparatus and further widespread use of such an image forming apparatus can be expected.

What is claimed is:

1. A fixing belt being an endless fixing belt comprising a base layer, an elastic layer made of an elastic material, and a release layer, wherein the elastic layer comprises:

a first elastic layer disposed on a side of the base layer; and a second elastic layer that is disposed on a side of the release layer and has a lower Universal hardness than that of the first elastic layer, wherein a Universal hardness of the second elastic layer is 3 to 7N/mm² and a thickness ratio of the second elastic layer to the elastic layer is 5 to 15%.

2. The fixing belt according to claim 1, wherein a Universal hardness of the first elastic layer is 5 to 11 N/mm².

3. The fixing belt according to claim 1, wherein a thickness of the second elastic layer is 5 to 30 μm.

4. The fixing belt according to claim 1, wherein a microhardness MD-1 hardness of the fixing belt is 80to 95.

5. The fixing belt according to claim 1, wherein a difference in Universal hardness between the first elastic layer and the second elastic layer is 0.1 to 5 N/mm².

6. A fixing device comprising:

an endless fixing belt;

two or more rollers configured to rotatably support the fixing belt;

a heater for heating the fixing belt; and a pressure roller for pressing a portion of the fixing belt that is rotatably supported by one of the two or more rollers, wherein the endless fixing belt is the fixing belt according to claim 1, and a pressing force of the pressure roller is 9.8 N/cm² or higher.

7. The fixing device according to claim 6, includes no oil application mechanism for applying an oil to either or both of the fixing belt and the pressure roller.

8. An image forming apparatus comprising a fixing device for fixing an unfixed toner image formed on a recording medium by an electrophotographic process on the recording medium by heating and pressing, wherein the fixing device is the fixing device according to claim 7.

9. An image forming apparatus comprising a fixing device for fixing an unfixed toner image formed on a recording medium by an electrophotographic process on the recording medium by heating and pressing, wherein the fixing device is the fixing device according to claim 6.

* * * * *